US005079390A

United States Patent [19]

Costanzo et al.

[11] Patent Number: 5,079,390

[45] Date of Patent: Jan. 7, 1992

[54] LOCK-OUT DEVICE FOR CIRCUIT BREAKERS

[75] Inventors: John J. Costanzo; Donald H. Marsden, both of Niagara Falls; Michael R. Yoder, N. Tonawanda, all of N.Y.

[73] Assignee: Occidental Chemical Corporation, Niagara Falls, N.Y.

[21] Appl. No.: 679,848

[22] Filed: Apr. 3, 1991

[51] Int. Cl.[5] ..... H01H 27/10

[52] U.S. Cl. ..... 200/43.14; 200/50 AA

[58] Field of Search ..... 200/50 R, 50 AA, 50 A, 200/50 C, 41.14

[56] References Cited

U.S. PATENT DOCUMENTS

| | | | |
|---|---|---|---|
| 3,296,391 | 1/1967 | Zavertnik et al. | 200/43.14 |
| 3,657,672 | 4/1972 | Flick et al. . | |
| 4,978,816 | 12/1990 | Castongvay et al. | 200/43.14 |

FOREIGN PATENT DOCUMENTS

| | | | |
|---|---|---|---|
| 677653 | 9/1961 | Canada | 200/43.14 |
| 172771 | 2/1986 | European Pat. Off. . | |
| 202991 | 11/1986 | European Pat. Off. . | |
| 245127A | 11/1987 | European Pat. Off. | 200/43.14 |
| 2730634 | 1/1979 | Fed. Rep. of Germany | 200/43.14 |

*Primary Examiner*—Leo P. Picard
*Assistant Examiner*—Lincoln Donovan
*Attorney, Agent, or Firm*—James F. Tao; Richard D. Fuerle

[57] ABSTRACT

Disclosed is a device that can be placed on the lever arm of a switch and locked to prevent the switch from being turned on. The device comprises a rigid body having a clasping device for removably fixing the rigid body to the lever arm, an aperture through the rigid body in which the shackle of a lock can be placed, positioned so that when the shackle is in the aperture access to the clasping device is blocked, and a bracing portion which contacts the switch to prevent its lever arm from being rotated when the device is attached thereto.

18 Claims, 1 Drawing Sheet

LOCK-OUT DEVICE FOR CIRCUIT BREAKERS

BACKGROUND OF THE INVENTION

This invention relates to a device that can be placed on a switch and locked to prevent the switch from being turned on. In particular, it relates to a device that has means for clasping the lever arm of a switch, where the clasping means are rendered inaccessible when the shackle of a lock is passed through the device.

In January of 1990 the Occupational Safety and Health Administration (OSHA) Lock-Out Rule (29 CFR 1910.147) went into effect. This rule requires that all energy sources be locked out before any work is done on an electrical circuit. The purpose of the rule is to prevent someone from turning on a circuit while work is being performed on that circuit.

At the present time circuits can be locked out by locking the entire circuit box. However, this is not satisfactory because circuit breakers that control circuits that are not being worked on are inaccessible and can not be reset. Various devices are available for locking out individual circuit breakers but these devices are not entirely satisfactory because they lack the strength to resist tampering, they can be applied to only the breakers of a specific manufacturer, they cannot be locked with a multiple lock out, or they cannot be applied so that several circuit breakers can be locked out at the same time.

SUMMARY OF THE INVENTION

We have invented a lock-out device for circuit breakers and other switches. Our device is simple but effective in preventing someone from turning a switch on or off. The device is so secure, in fact, that when properly applied, it can usually not be forced off without breaking the lever arm of the switch. The device can be applied to switches made by almost any manufacturer and is designed so that a number of independent switches can be locked out at the same time. The simple design of the device makes it relatively inexpensive to manufacture.

DESCRIPTION OF THE INVENTION

Figure 1:
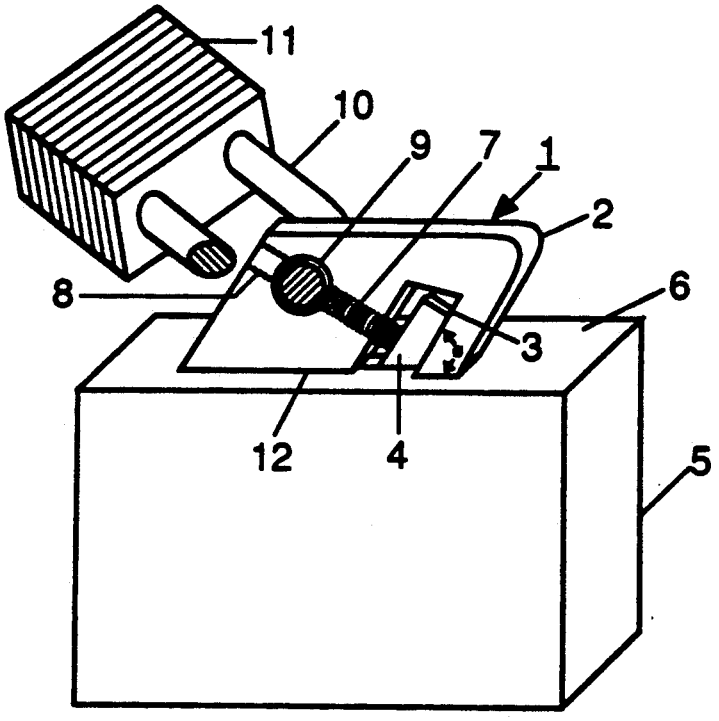
FIG. 1 is an isometric view partially in section illustrating a certain presently preferred embodiment of a lock-out device according to this invention as it is applied to a circuit breaker.

In FIG. 1, lock-out device 1 consists of a rigid body 2 made from a single piece of steel and having an aperture therethrough 3 of a size appropriate for receiving lever arm 4 of circuit breaker 5. The angle, $\phi$, of aperture 3 is approximately the same angle that lever arm 4 of circuit breaker 5 makes with exposed surface 6 of circuit breaker 5. Angle $\phi$ is typically an acute angle, usually about 70°. Rigid body 2 of lock-out device 1 is also provided with a set screw 7 which is preferably directed at the base of lever arm 4 on the side opposite angle $\phi$. Access to set screw 7 is achieved through aperture 8 in rigid body 2. Rigid body 2 is further provided with another aperature 9 into which can be placed shackle 10 of lock 11. Lock-out device 1 is provided with bracing portion 12 which rests against exposed surface 6 of circuit breaker 5 to prevent lever arm 4 from being rotated when locking device 1 is attached to lever arm 4.

To apply lock-out device 1 to circuit breaker 5, it is placed over lever arm 4 as shown in FIG. 1 and set screw 7 is tightened to secure lock-out device 1 to lever arm 4. Shackle 10 of lock 11 is then passed through aperture 9, effectively blocking access to set screw 7 and thereby preventing anyone from removing lock-out device 1.

Figure 2:
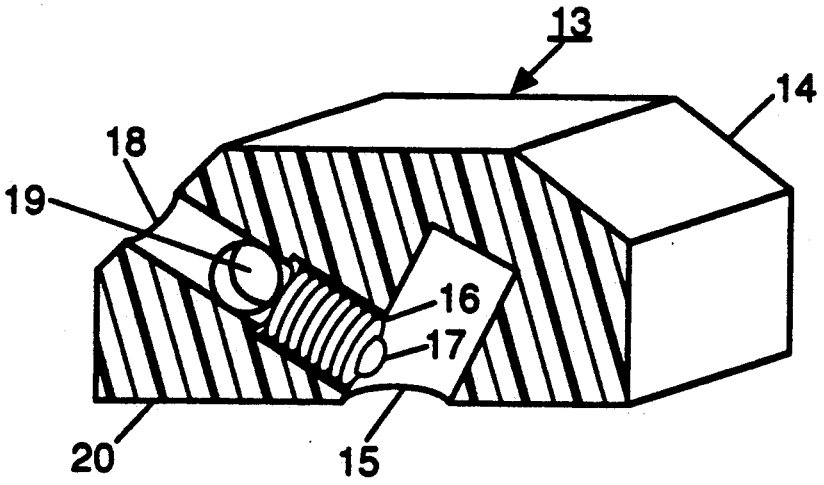
FIG. 2 is an isometric drawing in section of an alternative embodiment of a certain presently preferred lock-out device according to this invention.

In FIG. 2, lock-out device 13 consists of a rigid body 14, which can be made of a plastic material, such as a molded phenolaldehyde resin (e.g., phenolformaldehyde). Rigid body 14 is provided with a hole 15 for receiving the lever arm of a switch. Molded into rigid body 14 is a metal insert 16 into which is threaded metal set screw 17. Access to set screw 17 is obtained by means of hole 18 and such access can be blocked by placing a shackle through another hole 19, which crosses hole 18. Bracing portion 20 rests against the exposed portion of the switch.

Variations on the devices shown in the drawings are also contemplated within the scope of this invention. For example, other means for attaching the locking device to the lever arm can be used such as, for example, a clamp. The lock-out device of this invention is applicable to any type of switch having a lever arm which rotates, such as a circuit breaker or a light switch.

We claim:

1. A device for preventing a rotatable lever arm of a switch from being rotated, comprising a rigid body having
   (a) clasping means for removably attaching said rigid body to said lever arm;
   (b) an aperture through said rigid body in which the shackle of a lock can be placed, positioned so that when said shackle is in said aperture access to said clasping means is blocked; and
   (c) a bracing portion which can contact said switch to prevent said lever arm from being rotated when said device is attached to said lever arm.

2. A device according to claim 1 wherein said rigid body is made of steel.

3. A device according to claim 1 wherein said rigid body is made of plastic.

4. A device according to claim 1 wherein said clasping means is a set screw.

5. A device according to claim 1 wherein said aperture is a hole.

6. A device according to claim 1 wherein said aperture is a slot.

7. A device for preventing the lever arm of a switch from being flipped, comprising
   (a) a rigid body having a first aperture for receiving said lever arm and a bracing portion which contacts said switch to prevent said lever arm from being flipped when said lever arm is secured in said first aperture;
   (b) clasping means for removably attaching said rigid body to said lever arm;
   (c) a second aperture in said rigid body through which said clasping means can be engaged; and
   (d) a third aperture in said rigid body through which the shackle of a lock can pass, said third aperture crossing said second aperture, whereby access to said clasping means is blocked when said shackle is in said third aperture.

8. A device according to claim 7 wherein said rigid body is made of steel.

9. A device according to claim 7 wherein said rigid body is made of plastic.

10. A device according to claim 7 wherein said clasping means is a set screw.

11. A device according to claim 7 wherein said first aperture is a hole.

12. A device according to claim 7 wherein said first aperture is a slot.

13. A lock-out device for a circuit breaker that has a lever arm extending at an acute angle from an exposed surface comprising (a) a rigid rectangular body having a first aperture therein at an angle approximating said acute angle, for receiving said lever arm when said body rests on said exposed surface;

(b) clasping means for attaching said body to said lever arm;

(c) an access port in said body through which said clasping means can be engaged; and (d) a second aperture in said rigid body crossing said access port, through which the shackle of a lock can pass blocking access to said clasping means.

14. A device according to claim 13 wherein said rigid body is made of steel.

15. A device according to claim 13 wherein said rigid body is made of plastic.

16. A device according to claim 13 wherein said clasping means is a set screw.

17. A device according to claim 13 wherein said first aperture is a hole.

18. A device according to claim 13 wherein said first aperture is a slot.

* * * * *